US007806025B2

(12) United States Patent
Xinhong

(10) Patent No.: US 7,806,025 B2
(45) Date of Patent: Oct. 5, 2010

(54) SELF-ADJUSTING WRENCH

(75) Inventor: Zhou Xinhong, Daya Township (TW)

(73) Assignee: The Stanley Works, New Britain, CT (US)

( * ) Notice: Subject to any disclaimer, the term of this patent is extended or adjusted under 35 U.S.C. 154(b) by 75 days.

(21) Appl. No.: 12/191,930

(22) Filed: Aug. 14, 2008

(65) Prior Publication Data

US 2009/0044666 A1 Feb. 19, 2009

(30) Foreign Application Priority Data

Aug. 15, 2007 (TW) ..... 96130110 A

(51) Int. Cl.
*B25B 13/12* (2006.01)

(52) U.S. Cl. ..... 81/179

(58) Field of Classification Search ..... 81/179, 81/165, 427

See application file for complete search history.

(56) References Cited

U.S. PATENT DOCUMENTS

| | | | | |
|---|---|---|---|---|
| 385,595 A | | 7/1888 | Chappel | |
| 491,056 A | * | 1/1893 | Kraft | 81/141 |
| 546,295 A | | 9/1895 | Black | |
| 577,770 A | | 2/1897 | Martin | |
| 733,525 A | * | 7/1903 | Worden | 81/179 |
| 892,503 A | * | 7/1908 | Corbin | 81/140 |
| 1,308,440 A | | 7/1919 | Morrison | |
| 1,369,459 A | | 2/1921 | Miskimen | |
| 1,406,467 A | | 2/1922 | Matthey | |
| 2,565,154 A | * | 8/1951 | Wedvik | 81/179 |
| 2,592,781 A | | 4/1952 | Yavner | |
| 2,618,996 A | | 11/1952 | Logan | |
| 2,646,711 A | | 7/1953 | Yavner | |
| 2,697,372 A | | 12/1954 | Lane | |
| 2,700,315 A | | 1/1955 | Hermanson | |
| 2,712,259 A | | 7/1955 | Cowell | |
| 2,721,493 A | | 10/1955 | Bergland | |
| 2,795,160 A | | 6/1957 | Blasdell | |
| 2,797,600 A | | 7/1957 | Beaver | |
| 2,846,912 A | | 8/1958 | Day | |

(Continued)

FOREIGN PATENT DOCUMENTS

DE 202007002172 U1 5/2007

(Continued)

OTHER PUBLICATIONS

Extended European Search Report as issued for European Patent Application No. 08162483.5, dated Jul. 2, 2009.

*Primary Examiner*—David B Thomas
(74) *Attorney, Agent, or Firm*—Pillsbury Winthrop Shaw Pittman LLP

(57) ABSTRACT

An open-end wrench includes a handle portion and a containing portion. The containing portion includes a first jaw and a second jaw. The jaws define a containing groove configured to receive a workpiece. The open-end wrench also includes a chuck, a resilient member and a stop protector. The chuck is slidably mounted on the second jaw. The resilient member is operatively disposed between the second jaw and the chuck. The resilient member is configured to bias the chuck towards the handle. The protector stop interacts between the second jaw and the chuck to limit the extent of relative movement therebetween to limit the extent of compression of the resilient member.

27 Claims, 7 Drawing Sheets

U.S. PATENT DOCUMENTS

| | | | |
|---|---|---|---|
| 2,855,814 | A | 10/1958 | Yavner |
| 2,879,681 | A | 3/1959 | Blasdell |
| 2,907,243 | A | 10/1959 | Maclean |
| 2,910,902 | A | 11/1959 | Akers |
| 2,937,551 | A | 5/1960 | Akers |
| 2,983,173 | A | 5/1961 | Buxton, Jr. |
| 3,023,654 | A | 3/1962 | Stambaugh et al. |
| 3,079,820 | A | 3/1963 | Vantchoura |
| 3,095,769 | A | 7/1963 | Weinstein |
| 3,148,567 | A | 9/1964 | Wood |
| 3,165,015 | A | 1/1965 | Hinrichs |
| 3,198,041 | A | 8/1965 | Davis |
| 3,285,105 | A | 11/1966 | Davis |
| 3,306,142 | A | 2/1967 | Buteau |
| 3,309,949 | A | 3/1967 | Neff |
| 3,358,532 | A | 12/1967 | Allred |
| 3,641,847 | A | 2/1972 | Horton |
| 3,695,125 | A | 10/1972 | Glass et al. |
| 3,717,054 | A | 2/1973 | Thompson |
| 4,255,990 | A | 3/1981 | Doan |
| 4,276,790 | A | 7/1981 | Davis |
| 4,437,364 | A | 3/1984 | Martinmaas |
| 4,440,047 | A | 4/1984 | Robbins |
| 4,554,847 | A | 11/1985 | DeSantis |
| 4,637,284 | A | 1/1987 | Rosenbaum |
| 4,706,528 | A | 11/1987 | Inoue |
| 4,762,034 | A | 8/1988 | Foreman |
| 4,825,731 | A | 5/1989 | Stojanowski |
| 4,848,193 | A | 7/1989 | Wylie, III |
| 5,018,412 | A | 5/1991 | Wylie, III |
| 5,282,830 | A | 2/1994 | Reynolds |
| 5,287,777 | A | 2/1994 | Kolodziej |
| 5,533,428 | A | 7/1996 | Pradelski |
| 5,582,082 | A | 12/1996 | Gajo |
| 5,669,272 | A | 9/1997 | Hansen |
| 5,768,958 | A | 6/1998 | Gamble |
| 5,884,539 | A | 3/1999 | Baker |
| 5,996,445 | A | 12/1999 | Wiens et al. |
| 6,202,516 | B1 | 3/2001 | Kim |
| 6,412,372 | B1 | 7/2002 | Hsu |
| 6,530,298 | B1 | 3/2003 | Steffe |
| 6,637,300 | B2 | 10/2003 | Wu |
| 6,848,343 | B2 | 2/2005 | Wu |
| 6,945,143 | B2 | 9/2005 | Kim |
| 7,024,971 | B2 | 4/2006 | Stanton |
| 7,028,590 | B2 | 4/2006 | Tuan Mu |
| 7,077,035 | B1 | 7/2006 | Huang |
| 7,111,529 | B2 | 9/2006 | Pradelski |
| 7,188,551 | B2 | 3/2007 | Choi |
| 7,201,084 | B2 | 4/2007 | Yap |
| 7,228,768 | B1 | 6/2007 | Kim |
| 7,270,035 | B2 * | 9/2007 | Lu et al. ..... 81/179 |
| 7,418,891 | B2 * | 9/2008 | Choi ..... 81/98 |
| 2002/0043135 | A1 | 4/2002 | Chang |
| 2002/0162422 | A1 | 11/2002 | Kerzhner |
| 2003/0196525 | A1 | 10/2003 | Huang |
| 2004/0031359 | A1 | 2/2004 | Kady |
| 2006/0053982 | A1 | 3/2006 | Mo |
| 2006/0130620 | A1 | 6/2006 | Park et al. |
| 2006/0137496 | A1 | 6/2006 | Lu |
| 2006/0201283 | A1 | 9/2006 | Petkovic |
| 2007/0119281 | A1 | 5/2007 | Chang |
| 2007/0137444 | A1 | 6/2007 | Kim |

FOREIGN PATENT DOCUMENTS

| | | | |
|---|---|---|---|
| EP | 0224624 | A2 | 11/1985 |

* cited by examiner

SELF-ADJUSTING WRENCH

The present Patent Application is based on and claims priority to Patent Application No. 096130110, filed in China on Aug. 15, 2007, the entire contents of which is hereby incorporated by reference.

BACKGROUND OF THE INVENTION

1. Field of the Invention

The present invention pertains to wrenches and more particularly to a self-adjusting wrench.

2. Discussion of Related Art

Various wrenches are known. Some wrenches are closed-end wrenches, that is wrenches that encompass the circumference of a workpiece. In some circumstances, due to tight working quarters for example, use of a closed-end wrench to drive a workpiece may be precluded. As an alternative to a closed-end wrench, an open-ended wrench may be used.

While some designs for open-ended wrenches are available, these designs have some limitations.

FIG. 1 is an elevational view of a conventional open-end wrench. As shown in FIG. 1, conventional open-end wrench 10 has a handle 11 and two containing parts 12 on both sides of handle 11. Each containing part 12 has a containing groove 13 for receiving a nut-locking component 20, and two jaws 14, one jaw 14 on each side of containing groove 13.

When operated, open-end wrench 10 can be applied to nut-locking component 20. The containing groove 13 engages external surface of the nut-locking component 20 such that the two opposite containing surfaces 141 between the two jaws 14 are brought in contact with two symmetrical outer surfaces 21 of the nut-locking component 20. By applying a torque to the handle 11 of the wrench 10 to rotate the wrench 10, the nut-locking component 20 will rotate accordingly. Although the open-end wrench 10 provides the function of rotating the nut-locking component 20, it has the following deficiencies.

Because the working space to complete a full rotation 360° of the wrench 10 may be limited, the nut-locking component 20 may not complete a full rotation. Hence, after open-end wrench 10 rotates nut-locking component 20 to an intended position in one direction, the wrench 10 has to be removed from the nut-locking component 20 and rotated in the opposite direction in order to continue rotating nut-locking component 20 in the initial direction. Because the two jaws 14 are fixed, the open-end wrench 10 should be disconnected from nut-locking component 20 before rotating the wrench 10 in the opposite direction so as not to drive nut-locking component 20 to rotate in the opposite direction. Once the jaws 14 are brought again in contact against the two opposite surfaces 21, the rotation of nut-locking component 20 can be resumed. Therefore, the wrench 10 can be inconvenient to use.

Furthermore, when the open-end wrench 10 is applied to the nut-locking component 20, the two symmetrical outer surfaces 21 of nut-locking component 20 are held between the two parallel containing surfaces 141 in the containing groove 13 of the open-end wrench 10. Therefore, when the wrench is applied to the nut-locking component 20 whose size (a distance between the two opposite surfaces 21) is smaller than a distance between the two parallel containing surfaces 141, each of the two containing surfaces 141 forms an angle relative to each of the two surfaces 21 of nut-locking component 20. When a torque is exerted on open-end wrench 10 to rotate nut-locking component 20, the nut-locking component 20 can sometimes be stripped.

BRIEF SUMMARY OF THE INVENTION

An aspect of the present invention is to provide an open-end wrench including a handle portion and a containing portion. The containing portion includes a first jaw and a second jaw. The jaws define a containing groove configured to receive a workpiece. The open-end wrench also includes a chuck base, a resilient member and a stop protector. The chuck base is slidably mounted on the second jaw. The resilient member is operatively disposed between the second jaw and the chuck base. The resilient member is configured to bias the chuck base towards the handle. The protector stop interacts between the second jaw and the chuck base to limit the extent of relative movement therebetween to limit the extent of compression of the resilient member.

DETAILED DESCRIPTION OF SEVERAL EMBODIMENTS OF THE INVENTION

Figure 1:
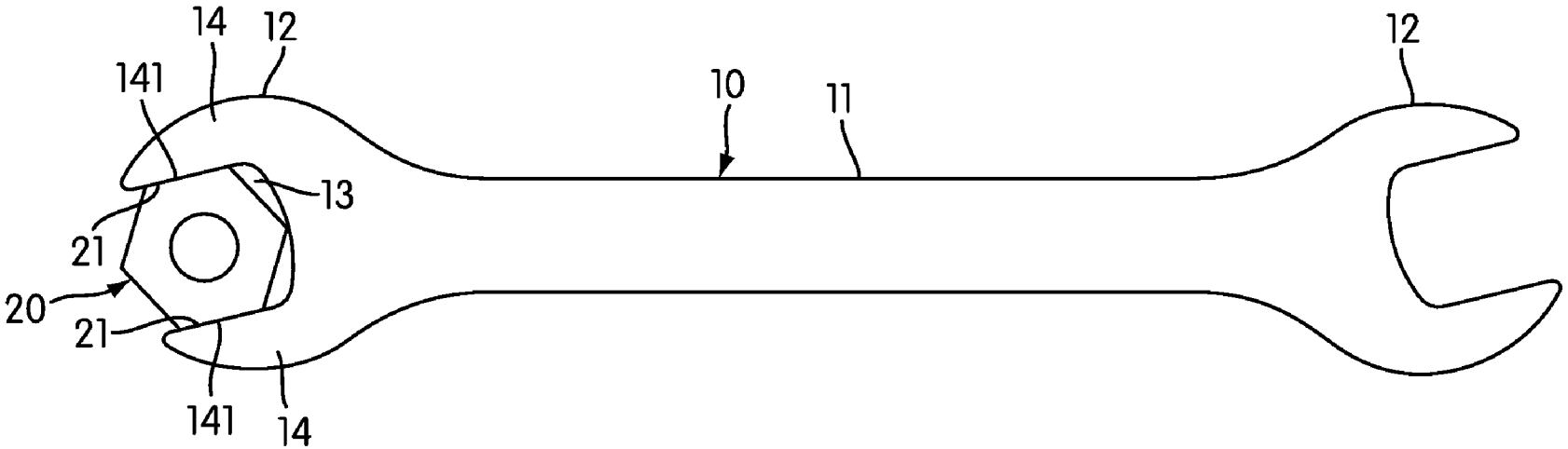
FIG. 1 PRIOR ART
FIG. 1 is an elevational view of a conventional open-end wrench, in accordance with the prior art.
Figure 2:
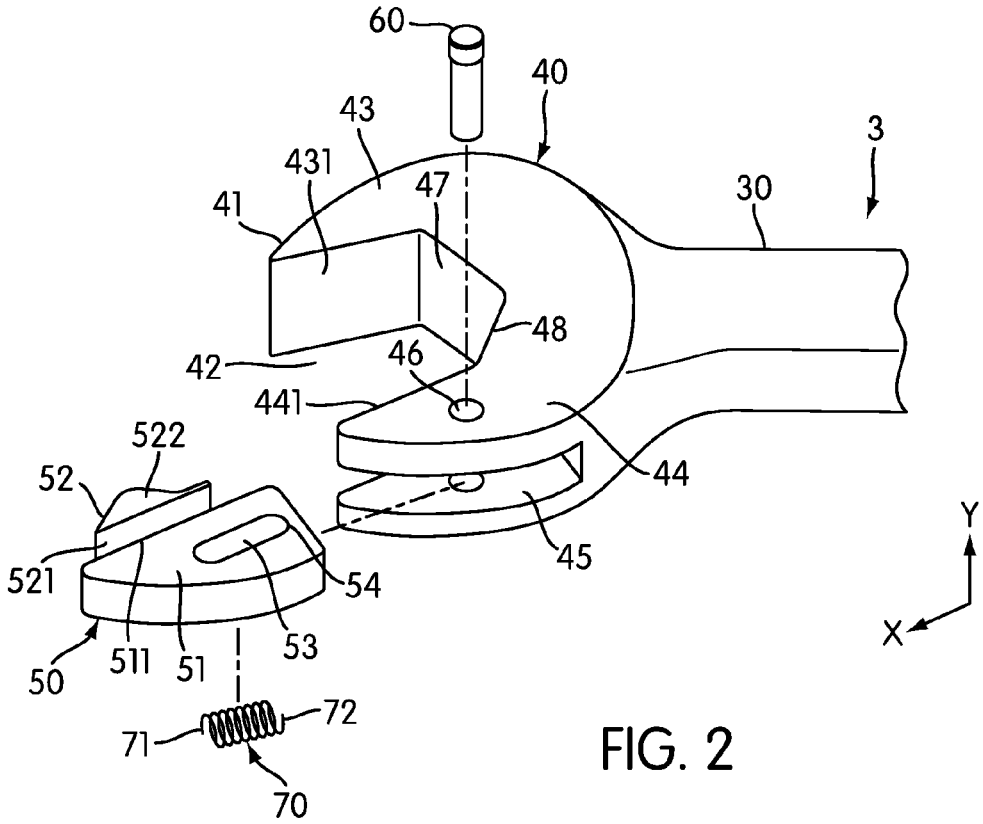
FIG. 2 is an exploded perspective view of a wrench, according to an embodiment of the present invention.
Figure 3:
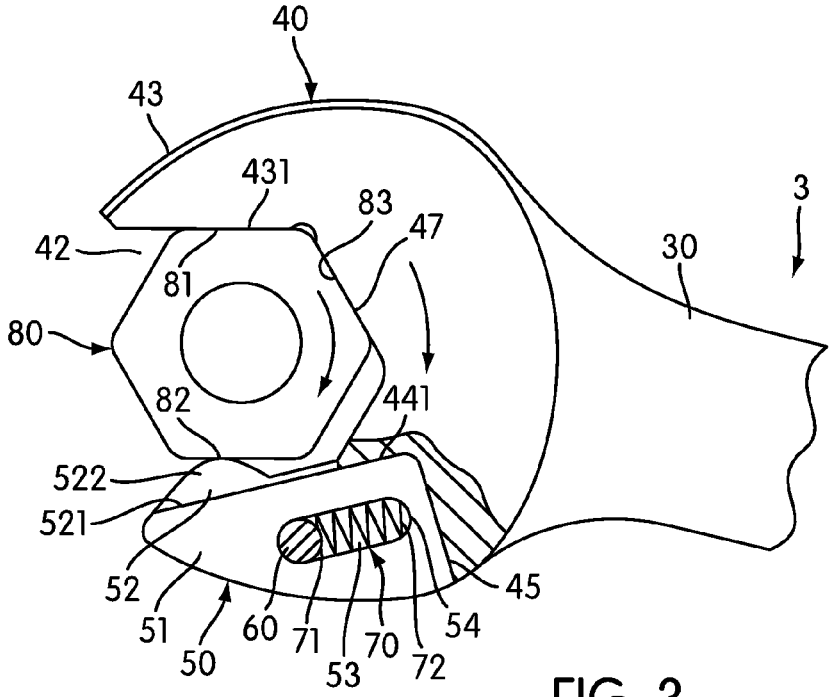
FIG. 3 is a combined elevational view and broken away section view showing a condition when the wrench drives a nut-locking component to rotate and become tightened, according to an embodiment of the present invention.

FIG. 2 is an exploded perspective view of an open-end wrench 3, according to an embodiment of the present invention and FIG. 3 is a combined elevational view and broken away sectional view of the open-end wrench 3. Open-end wrench 3 comprises a handle 30, a containing part 40, a chuck base 50, a dowel pin 60 and a resilient member 70.

The containing part 40 can be provided on one side of the handle 30 or on both sides of the handle 30. As used herein, the term containing part refers broadly to the open-ended region of an open ended wrench that receives a fastener or nut. In one embodiment, the containing part 40 includes containing groove 42 having an outer surface 41 which contacts handle 30. The containing groove 42 is configured to receive nut-locking component 80. The containing part 40 also includes a first jaw 43 and a second jaw 44 on opposite sides of containing groove 42. A sliding groove 45 is provided in the second jaw 44 along a first direction X. The sliding groove 45 communicates with containing groove 42 and outer surface 41. The containing part 40 further includes an opening 46 provided on the second jaw 44 along a second direction Y perpendicular to the first direction X. The opening 46 communicates with sliding groove 45.

The first jaw 43 has a first pressing surface 431 and the second jaw 44 has a second pressing surface 441. The first pressing surface 431 of the first jaw 43 and the second pressing surface 441 of the second jaw 44 are slanted relative to each other, i.e., not parallel to each other. In addition, the containing part 40 has also a third pressing surface 47 and a fourth pressing surface 48. The third pressing surface 47 and the fourth pressing surface 48 intersect and extend, respectively, from the first pressing surface 431 and the second pressing surface 441 towards the handle 30.

The chuck or chuck base 50 is configured to be slidably mounted in sliding groove 45 of the second jaw 44. As used herein, the term "chuck" or "chuck base" are used synonymously and refers broadly to a movable part mounted on a jaw that can engage a nut or fastener to drive the nut or fastener. The chuck base 50 includes a sliding block 51 configured to be mounted inside sliding groove 45. The sliding block 51 is movable inside sliding groove 45 along the first direction X. The sliding block 51 has an elongated aperture 53 along the first direction X. The elongated aperture 53 has an internal surface 54.

The chuck base 50 also includes a clamp splice 52 configured to be mounted to inner surface 511, of sliding block 51 which faces containing groove 42. The clamp splice 52 has a backstop surface 521, one side of which is opposite to inner surface 511. The clamp splice 52 extends away from the top and bottom edges of inner surface 511. The clamp splice 52 has a containing part 522 with a bumped shape oriented towards groove 42. In this embodiment, the clamp splice 52 is fixed to sliding block 51. Alternatively, the clamp splice 52 can be configured to move along the inner surface 511 of sliding block 51.

When the sliding block 51 of chuck base 50 is mounted inside the sliding groove 45 of the second jaw 44, the elongated aperture 53 can be aligned with the opening 46 in the second jaw 44. The dowel pin 60 can then be inserted into the opening 46 and elongated aperture 53, along the second direction Y. As a result, the sliding block 51 can slide back and forth inside the sliding groove 45 guided by the dowel pin 60 and the backstop surface 521, of clamp splice 52 which comes in contact with second pressing surface 441 of the second jaw 44, while being prevented from leaving the slide groove 45.

In this embodiment, the resilient member 70 is a spring. However, any other suitable resilient member can be used, such as an elastic material. The resilient member 70 is disposed in elongated aperture 53. An extremity 71 of the resilient member 70 is brought in contact with the dowel pin 60 and an opposite extremity 72 of the resilient member 70 is brought in contact with surface 54 of the elongated aperture 53. As a result, the resilient member 70 can exert a force on the sliding block 51 of chuck base 50 to bias the chuck base 50 towards the handle 30.

In operation, the open-end wrench 3 is applied to a nut-locking component 80, as depicted in FIG. 3, by aiming containing groove 42 of containing part 40 at nut-locking component 80 so as to position the nut-locking component 80 inside containing groove 42. Two symmetrical outer surfaces 81 and 82 of nut-locking component 80 are held by and positioned between the first pressing surface 431 of the first jaw 43 and containing part 522 of clamp splice 52, respectively. At the same time, outer surface 83 of nut-locking component 80 is also brought in contact with the third pressing surface 47 of containing part 40. When a clockwise torque is exerted on handle 30, nut-locking component 80 is driven to rotate clockwise, for example to tighten the nut-locking component, as illustrated by the arrows in FIG. 3.

Figure 4:
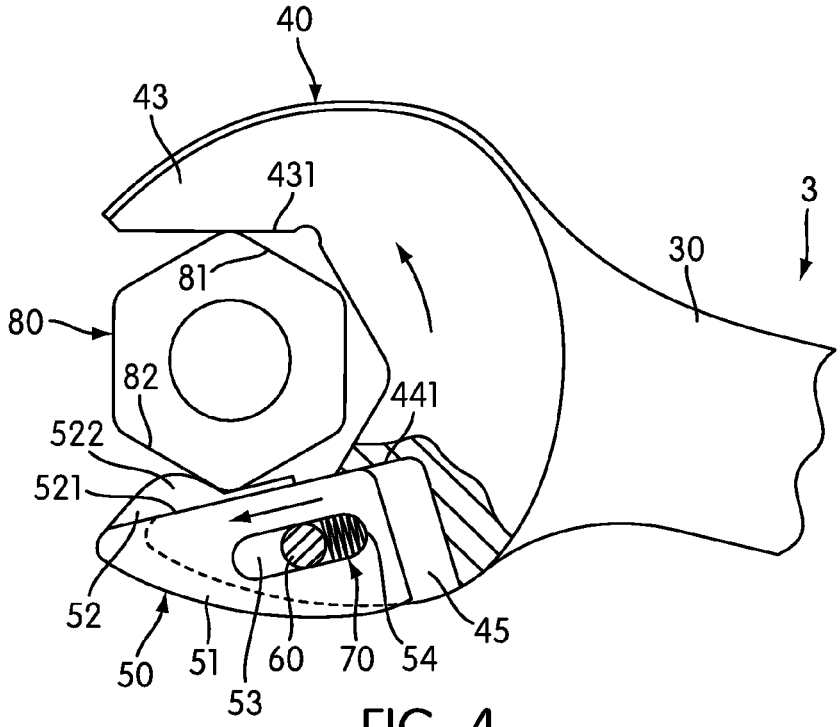
FIG. 4 is a combined elevational view and broken away view showing a condition of idle running of the wrench depicted in FIG. 3.

FIG. 4 is a combined elevational view and broken away view showing the wrench depicted in FIG. 3 when rotated counter-clockwise and running idle. As shown in FIG. 4, when a counter-clockwise torque is exerted on handle 30, initially the clamp splice 52 of chuck base 50 will be driven by nut-locking component 80 and the chuck base 50 will be moved away from handle 30 along the first direction X. The two symmetrical outer surfaces 81 and 82 of nut-locking component 80 will no longer be held by and positioned between the first pressing surface 431 of the first jaw 43 and the containing part 522 of clamp splice 52. When the chuck base 50 moves away from the handle 30 along the first direction X, the dowel pin 60 being fixed and held in opening 46, the resilient member 70 is compressed between the dowel pin 60 and the surface 54 of the elongated aperture 53, as depicted in FIG. 4. In this case, the open-end wrench 3 is running idle in that it does not drive nut-locking component 80 to rotate counter-clockwise. It is noted that the clamp splice 52 also moves along with the chuck base 50.

When another counter-clockwise torque is exerted on the handle 30, the handle will drive nut-locking component 80 to rotate slightly, and drive outer surface 81 of nut-locking component 80 to press against the first pressing surface 431 of the first jaw 43. Thereafter, the resilient member 70 will drive chuck base 50 to move towards handle 30 along the first direction X. The two symmetrical outer surfaces 81 and 82 of nut-locking component 80 are held by and positioned between the first pressing surface 431 of the first jaw 43 and containing part 522 of clamp splice 52. When a clockwise torque is exerted on handle 30, nut-locking component 80 is driven to rotate clockwise. Thus, nut-locking component 80 can be further tightened.

Figure 5:
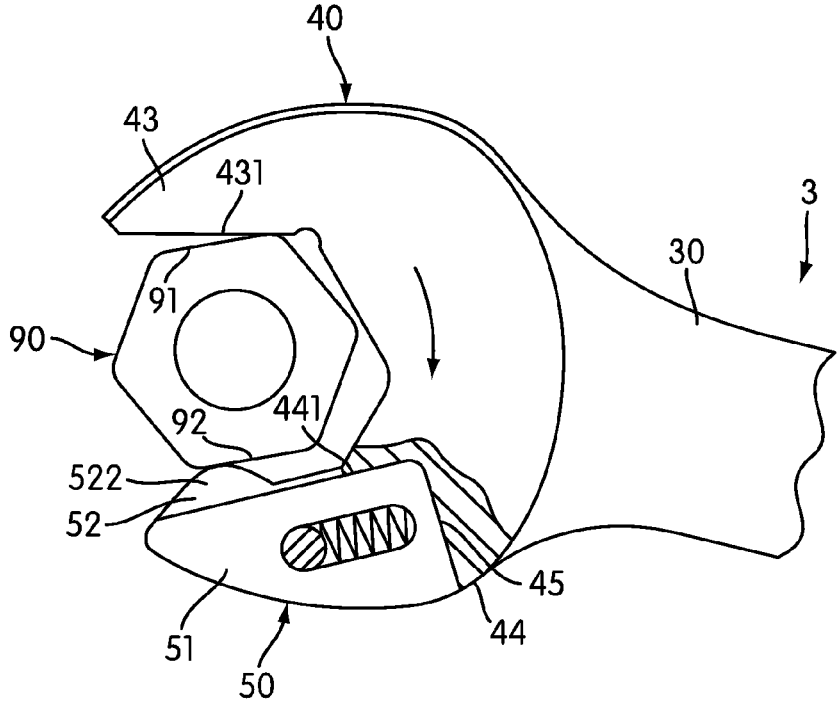
FIG. 5 is a combined elevational view and broken away view showing a condition when the wrench shown in FIG. 3 is applied to a nut-locking component of a smaller size.

FIG. 5 is a combined elevational view and broken away view showing a condition when the wrench shown in FIG. 3 is applied to a nut-locking component of a smaller size. As shown in FIGS. 3 and 5, the first pressing surface 431 of the first jaw 43 is working together with containing part 522 of clamp splice 52 to hold the two symmetrical outer surfaces 91 and 92 of nut-locking component 90. The first pressing surface 431 and the second pressing surface 441 of the second jaw 44 are slanted and not parallel to each other. Therefore, when the open-end wrench is applied on a nut-locking component 90 of a smaller size, the two, symmetrical outer surfaces 91 and 92 of nut-locking component 90 can be held partially by and positioned between the first pressing surface 431, and containing part 522. As a result, the nut-locking component 90 can be further tightened without damaging the nut-locking component 90. Therefore, the open-end wrench 3 can be configured to quickly engage and position workpieces of various sizes.

Figure 6:
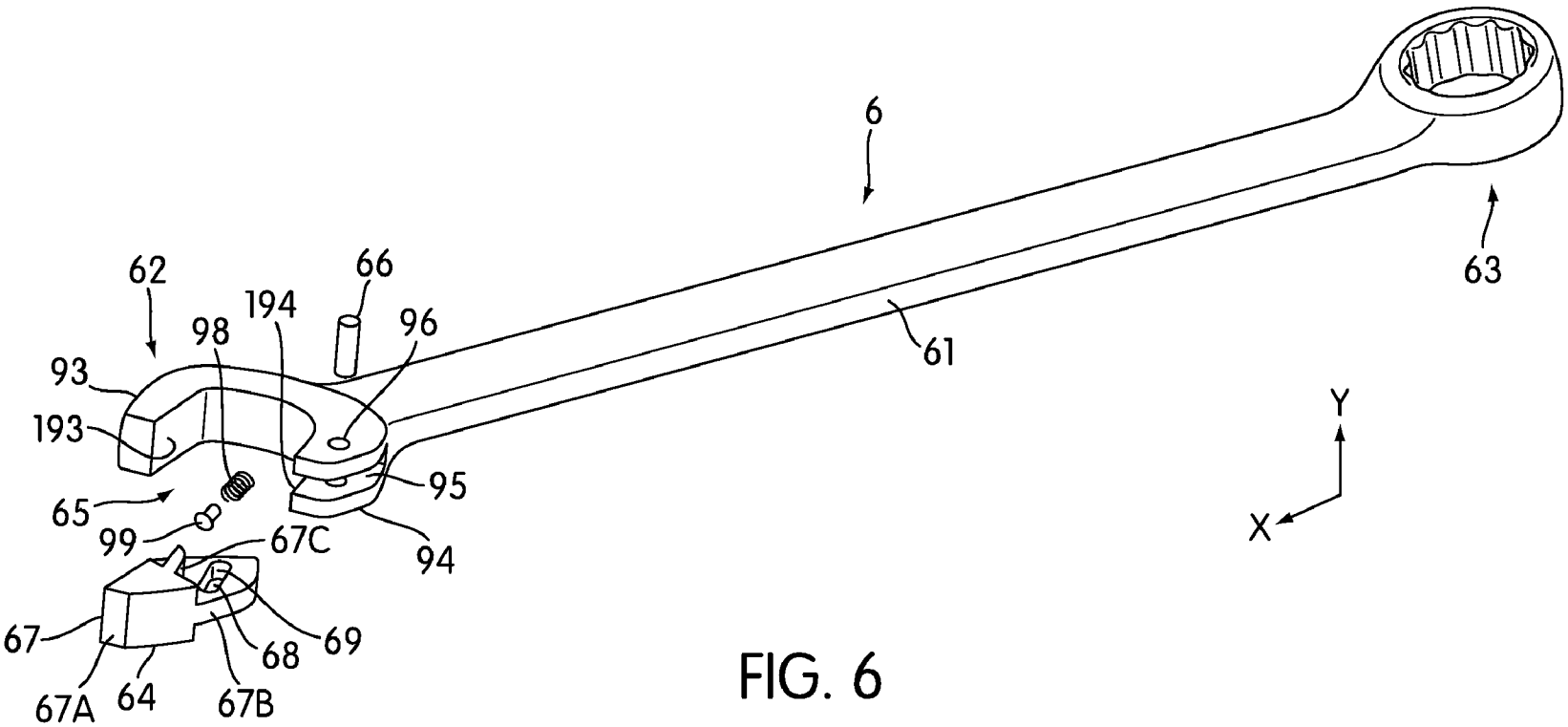
FIG. 6 is an exploded perspective view of a wrench, according to another embodiment of the present invention.

FIG. 6 is an exploded perspective view of an open-end wrench 6, according to another embodiment of the present invention. Open-end wrench 6 is similar in many aspects to the open-end wrench 3. Open-end wrench 6 comprises a handle 61, an open containing part 62, a closed containing part 63, a chuck base or pawl 64, a dowel pin 66, a resilient member 98, and in this embodiment, a spring protector stop 99 (in the form of a pin in this embodiment).

Although the open containing part 62 is shown in FIG. 6 on one side of the handle 61, another open containing part 62 can be provided on an opposite side of the handle 61 instead of the closed containing part 63. The containing part 62 includes containing groove or slot 65. The containing groove 65 is configured to receive nut-locking component 100 (shown in FIGS. 7A-7C). In this embodiment, a back surface of containing groove 65 has a curved configuration. The containing part 62 also includes a first jaw 93 and a second jaw 94 on opposite sides of containing groove 65. A sliding groove 95 is provided in the second jaw 94 along a first direction X. As seen in FIG. 6, the sliding groove 95 communicates with containing groove 65. The containing part 62 further includes an opening 96 provided on the second jaw 94 along a second direction Y perpendicular to the first direction X. The opening 96 communicates with sliding groove 95.

The first jaw 93 has a first pressing surface 193 and the second jaw 94 has a second pressing surface 194. The first pressing surface 193 of the first jaw 93 and the second pressing surface 194 of the second jaw 94 are slanted relative to each other in the first direction X, i.e., not parallel to each other in the first direction X.

Similar to the previously described embodiment, the chuck base 64 is configured to be slidably mounted in sliding groove 95 of the second jaw 94. The chuck base 64 includes a sliding block 67 configured to be mounted inside sliding groove 95. The sliding block 67 is movable inside sliding groove 95 along the first direction X. The sliding block 67 has a thick upper portion 67A and a thin flat lower portion 67B disposed generally centrally below the thick portion 67A and extending downwardly and rearwardly relative to thick portion 67A. The transitioning surface extending laterally from the thick portion 67A to the thin flat portion 67B form an edge portion or edge surface 67C. The edge surface 67C generally faces downwardly and is an under surface of thick portion 67A that engages the upward facing second pressing surface 194 of the second jaw 94. The thin flat portion 67B is configured to slide inside sliding groove 95. The sliding block 67 has also a ramped surface 67D. (shown in FIGS. 7A-7C). The ramped surface 67D has a ramp portion 67E and surface portions 67F and 67G. The ramp portion 67E is angled relative to the two surfaces 67F and 67G. When the chuck base 64 is mounted in sliding groove 95, the edge 67C of the sliding block 67 abuts and slides against the second pressing surface 194 of the second jaw 94. In addition, the sliding block 67 has an elongated aperture 68 along the first direction X provided in the thin flat portion 67B. The elongated aperture 68 has an internal surface 69.

Similar to the previous embodiment, when the sliding block 67 of chuck base 64 is mounted inside the sliding groove 95 of the second jaw 94, the elongated aperture 68 can be aligned with the opening 96 in the second jaw 94. The dowel pin 66 can then be inserted through the opening 96 and through the elongated aperture 68, along the second direction Y. As a result, the sliding block 67 can slide back and forth inside the sliding groove 95 guided by the dowel pin 66 and the edge 67C of the sliding block 67 while being prevented from leaving the sliding groove 95.

Figure 7A:
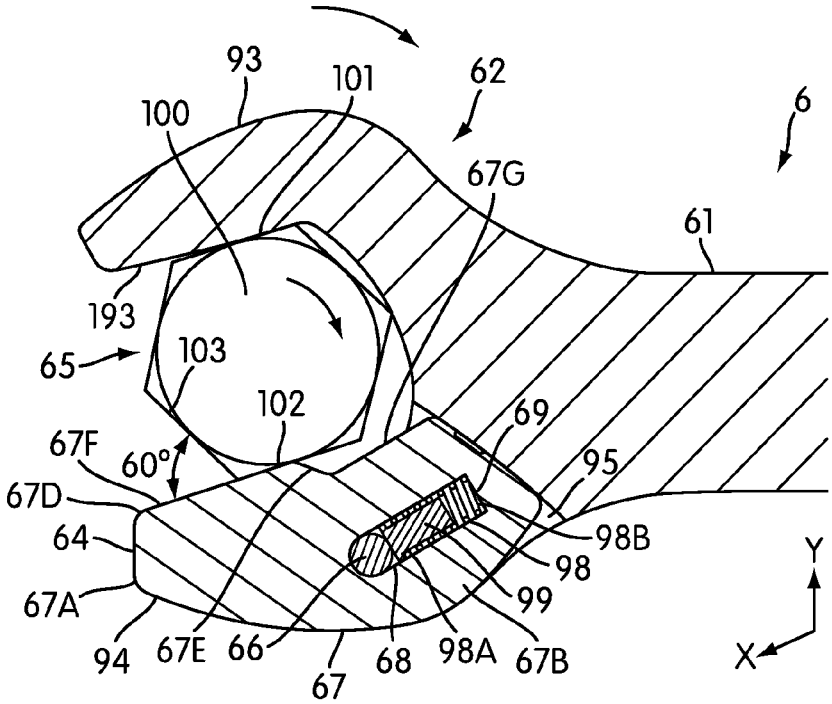
FIGS. 7A, 7B and 7C show the various phases of operation of the wrench depicted in FIG. 6.
Figure 7B:
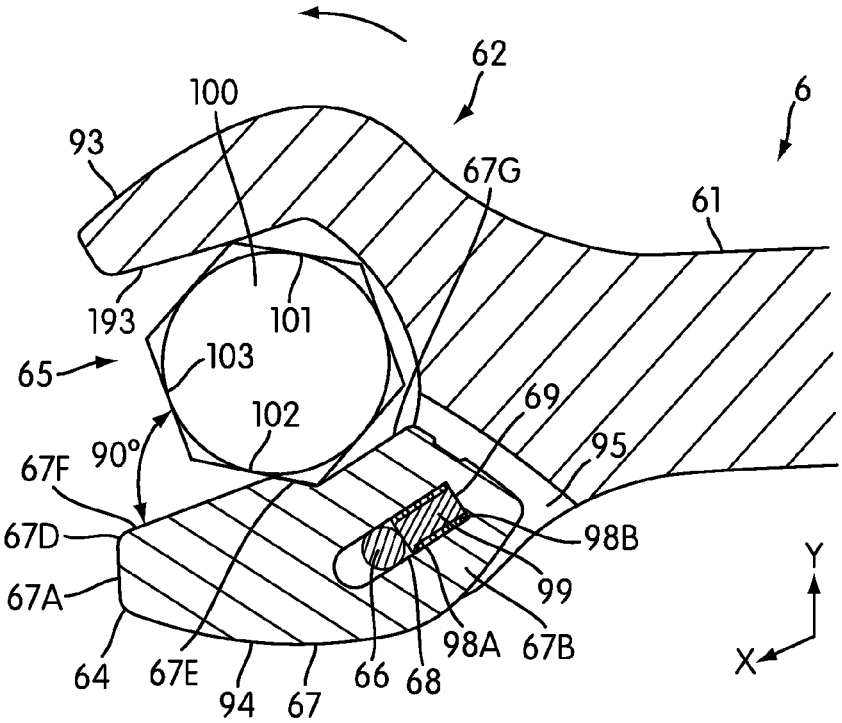
Figure 7C:
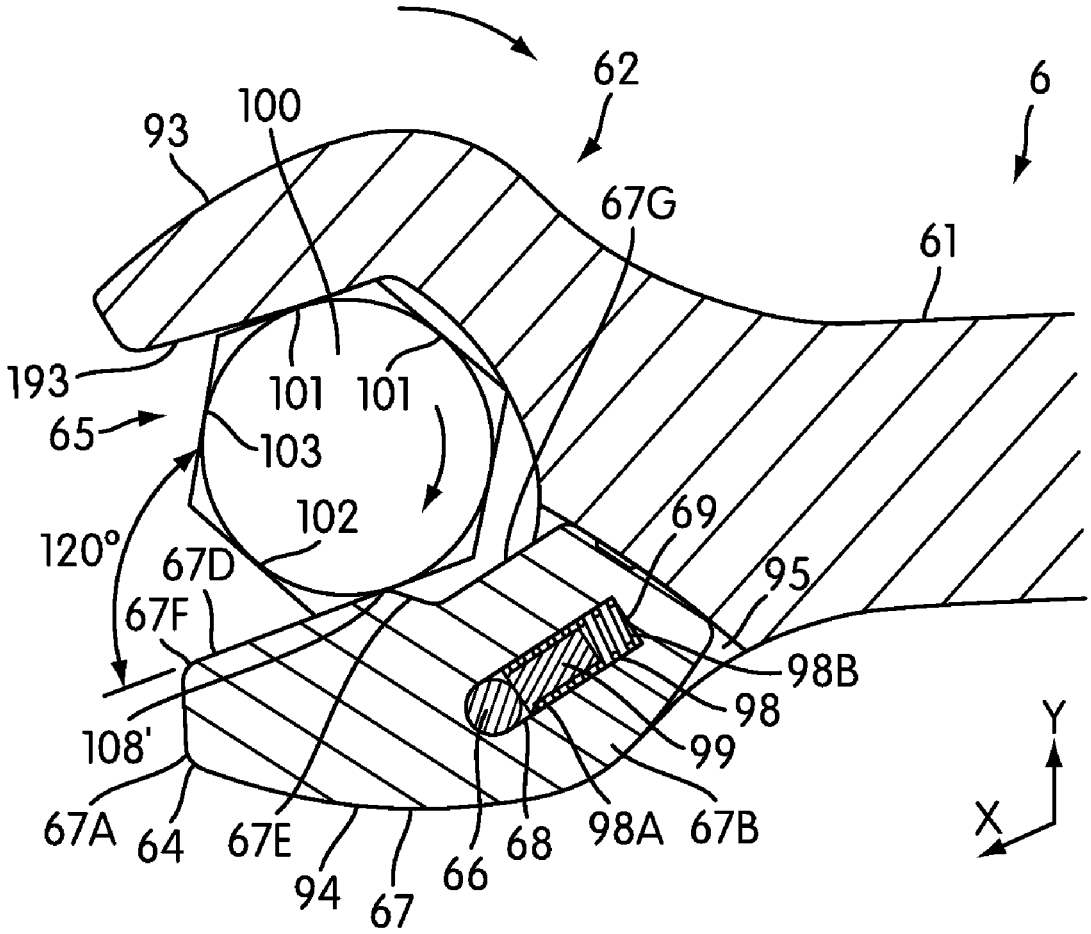

FIGS. 7A-7C are cross-sectional views of the open-end wrench 6 showing various phases of operation of the open-end wrench 6 depicted in FIG. 6 and the relative positioning of the resilient member 98 and protection pin 99 during the operation of wrench 6. The resilient member 98 is disposed in the elongated aperture 68. In this embodiment, the resilient member 98 is a spring. However, any other suitable resilient member can be used, such as an elastic or compressible material. An extremity 98A of the resilient member 98 is brought in contact with the dowel pin 66 and an opposite extremity 98B of the resilient member 98 is brought in contact with internal surface 69 of the elongated aperture 68. In this way, the resilient member 98 can exert a force on the sliding block 67 of chuck base 64 to bias the sliding block 67 towards the handle 30. The protection pin 99 is disposed to protect the resilient member 98. In one embodiment, the protection pin or protector stop 99 is disposed inside the resilient member (e.g., a spring) 98. For example, the protection pin 99 can be a cylindrical piece of metal that can be inserted in the core of the spring 98. In one embodiment, the protection pin 99 may optionally be provided with a head portion at one end of the cylindrical piece of metal. A diameter of the head portion can be sized to be larger than a diameter of the spring 98 so that the head is positioned outside the spring confines, and the protection pin 99 can move with the compression and elongation of the spring 98. In one embodiment (e.g., where the protector stop comprises the pin 99 within the spring), during compression of the spring 98, the protection pin 99 can also prevent bending and/or distortion of the spring 98. The protection pin 99, can also be selected to limit compression of the resilient member 98. That is, because the protective stop or pin 99 is disposed between the dowel pin 66 and the opposing end surface 69 of groove 68 (for example, the head of the pin 99 facing the pin 99), the length of pin 99 is sandwiched between pin 66 and surface 69 to limit the extent of compression of the spring 98.

Although in this embodiment the stop 99 takes the form of a pin within spring 98, it is contemplated that a different structure that limits the extent of movement of sliding block 67 to protect excessive compression of spring 98. For example, stopping edges can be provided on the flat surface 67B and on an opposing surface of the second jaw 94 inside the sliding groove 95, which when brought in contact, stop the movement of the sliding block 67 to thus limit the compression of the spring 98.

In operation, the open-end wrench 3 is applied to a nut-locking component 100, as depicted in FIG. 7A, by directing containing groove 65 of containing part 62 towards nut-locking component 100 so as to position the nut-locking component 100 inside containing groove 65. Two symmetrical outer surfaces 101 and 102 of nut-locking component 100 are held by and positioned between the first pressing surface 193 of the first jaw 93 and the surface portion 67F of ramped surface 67D in sliding block 67 of the chuck base 64, respectively. When a clockwise torque is exerted on handle 61, nut-locking component 100 is driven to rotate clockwise, for example to tighten the nut-locking component 100, as illustrated by the arrow in FIG. 7A. For example, in the case where the nut-locking component 100 is a nut having a hexagonal head (as shown in FIGS. 7A-7C), one side 103 of the hexagonal head of the nut-locking component 100 makes an angle of about 60° with the surface portion 67F of ramped surface 67D of the sliding block 67 (as shown in FIG. 7A).

As shown in FIG. 7B, when a counter-clockwise torque is exerted on handle 61, initially the sliding block 67 of chuck base 64 will be driven by nut-locking component 100 and the sliding block 67 of the chuck base 64 will be moved away from handle 61 along the first direction X. The two symmetrical opposite outer surfaces 101 and 102 of nut-locking component 100 will no longer be held and positioned between the first pressing surface 193 of the first jaw 93 and the surface portion 67F in sliding block 67. A portion of the surface 102 of the nut-locking component 100 contacts the ramp portion 67E which is angled with respect to the surface portion 67F of ramped surface 67D. In one embodiment, the angle between the surface portion 67F and the ramp portion 67E is approximately 210°. When the sliding block 67 moves away from the handle 61 along the first direction X, with the dowel pin 66 being fixed and held by the second jaw 94 inside opening 96, the resilient member 98 is compressed between the dowel pin 66 and the surface 69 of the elongated aperture 68. As described in the above paragraphs, the resilient member 98 is only compressed to a certain extent, as the protection pin 99 disposed inside the resilient member 98 will act as a stop to limit the extent of travel. In one embodiment, the protection pin 99 can also guide the resilient member 98 during its compression, thus preventing bending and/or distortion of the resilient member 98.

During the counter-rotation phase, the open-end wrench 6 runs idle in that the movement of sliding block 67 allows the component 100 to slip within the groove 65 so that wrench 6 does not drive nut-locking component 100 to rotate counter-clockwise. In the case where the nut-locking component 100 is a nut having a hexagonal head (as shown in FIGS. 7A-7C), the side 103 of the hexagonal head of the nut-locking component 100 now makes an angle of about 90° with the surface portion 67F of ramped surface 67D of the sliding block 67 (as shown in FIG. 7B).

As shown in FIG. 7C, when another clockwise torque is exerted on the handle 61, surface 101' of nut-locking component 100 adjacent to surface 101 is brought in contact with the first pressing surface 193 of the first jaw 93 and surface 102' of nut-locking component 100 adjacent to surface 102 is brought in contact with surface portion 67F of ramped surface 67D of the sliding block 67. The resilient member 98 will drive chuck base 64 to move towards handle 61 along the first direction X. When a clockwise torque is exerted on handle 61, nut-locking component 100 is driven to rotate clockwise. Thus, nut-locking component 100 can be further tightened.

Figure 8:
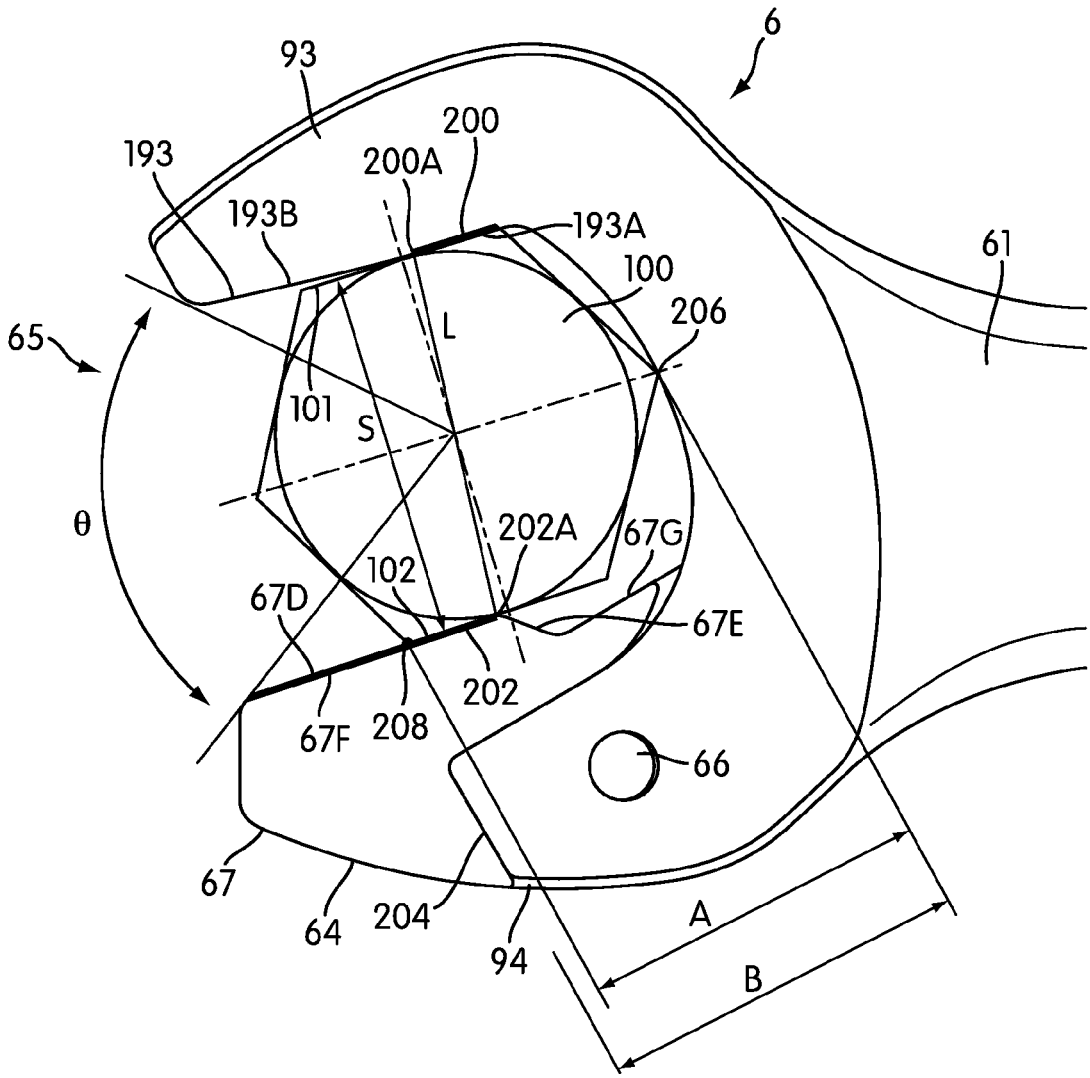
FIG. 8 is an elevational view of a portion of the wrench depicted in FIG. 6 showing dimensions of features of the wrench depicted in FIGS. 6 and 7A-7C.

FIG. 8 is an elevational view of the open-end wrench 6 depicted in FIGS. 6 and 7A-7C showing dimensions of some features of the wrench 6. As shown in FIG. 8, the first pressing surface 193 has a first surface portion 193A and a second surface portion 193B. The first surface portion 193A and the second surface portion 193B are slightly angled relative to each other. The first surface portion 193A is parallel to surface portion 67F of ramped surface 67D. The first surface 193A of the first pressing surface 193 contacts the surface 101 of the nut-locking component 100 at contact area 200. The contact area 200 between the surface 101 and the surface portion 193A is shown in FIG. 8 as a bold line. The surface portion 67F of ramped surface 67D of the sliding block 67 contacts the surface 102 of the nut-locking component 100 at contact area 202. The contact area 202 between the surface 102 and the surface portion 67F of the ramped surface 67D is shown in FIG. 8 as a bold line. The contact area 202 is substantially parallel to the contact area 200.

It must be appreciated from the above paragraphs that in one embodiment, the first jaw 93 has a rearward surface region 193A that is parallel to a first workpiece engaging surface 67F of the slidable chuck 64. The first jaw 93 has a forward surface region 193B that extends away from the workpiece engaging surface 67F as it extends away from the rearward surface region 193A. A second workpiece engaging surface 67E of the slidable chuck 64 ramps downwardly as it extends rearwardly from the first workpiece engaging surface 67F.

The containing groove 65 of the open-end wrench 6 has a depth B defined as a distance between an edge 204 of the second jaw 94 and a contact point (or contact line) 206 between the nut-locking component 100 and an interior surface of the containing groove 65. The depth B is greater than a distance A between an extremity 208 of the nut-locking component 100 within contact area 202 and the contact point (or contact line) 206. By configuring the containing groove 65 such that the depth B is greater than the distance A, the chuck base 64 can be prevented from being pushed out away from the second jaw 94 when operating the wrench 6 (for example, during tightening, i.e. clockwise rotation, of the nut-locking component 100).

Furthermore, in this configuration, a distance L between an edge 200A in contact area 200 and an edge 202A in contact area 202 is greater than a distance S between the surface 101 and the opposite surface 102 of the nut-locking component 100. In this configuration, the nut-locking component 100 is engaged and potential slip of the nut-locking mechanism can be prevented when driving the nut-locking component 100 in the clockwise direction.

It must also be appreciated that one of the advantages of the protector stop 99 is that the protector stop 99 can also be used in a device with a movable jaw, as disclosed in U.S. patent application Ser. No. 12/027,103, hereby incorporated by reference in its entirety.

Although the open-end wrenches 3 and 6 are depicted herein as operating a nut-locking component 80, 100 having a hexagonal-shaped head, the wrenches 3 and 6 can be used to operate other nut-locking components. For example, the wrenches 3 and 6 can be used to operate a nut or bolt having a polygonal head, such as, a square head, an octagonal head, etc. The many features of the present invention are apparent from the detailed specification and thus, it is intended by the appended claims to cover all such features of the described open-end wrench which follow the true spirit and scope of the invention.

It should be appreciated that in one embodiment, the drawings herein are drawn to scale (e.g., in correct proportion). However, it should also be appreciated that other proportions of parts may be employed in other embodiments.

Furthermore, since numerous modifications and changes will readily occur to those of skill in the art, it is not desired to limit the invention to the exact construction and operation described herein. Accordingly, all suitable modifications and equivalents should be considered as falling within the spirit and scope of the invention.

What is claimed:

1. An open-end wrench comprising:

a handle portion and a containing portion, the containing portion comprising a first jaw and a second jaw, the jaws defining a containing groove configured to receive a workpiece;

a chuck slidably mounted on the second jaw;

a resilient member operatively disposed between the second jaw and the chuck, the resilient member being configured to bias the chuck towards the handle; and a protector stop interacting between the second jaw and the chuck to limit the extent of relative movement therebetween to limit the extent of compression of the resilient member.

2. The open-end wrench of claim 1, wherein the first jaw and the second jaw are slanted relative to each other.

3. The open-end wrench of claim 1, wherein the first jaw has a rearward surface region that is parallel to a first workpiece engaging surface of the slidable chuck, and wherein the first jaw has a forward surface region that extends away from the workpiece engaging surface as it extends away from the rearward surface region.

4. The open-end wrench of claim 3, wherein a second workpiece engaging surface of the slidable chuck ramps downwardly as it extends rearwardly from the first workpiece engaging surface.

5. The open-end wrench of claim 1, wherein the second jaw includes a sliding groove.

6. The open-end wrench of claim 5, wherein the sliding groove extends in a first direction and communicates with the containing groove.

7. The open-end wrench of claim 6, wherein the second jaw further includes an opening in communication with the sliding groove.

8. The open-end wrench of claim 7, wherein the opening extends in a second direction substantially perpendicular to the first direction.

9. The open-end wrench of claim 5, wherein the chuck comprises a sliding block configured to be mounted inside the sliding groove, the sliding block being movable within the sliding groove.

10. The open-end wrench of claim 9, wherein the sliding block comprises a thick portion and a thin flat portion, the thick and thin portions forming an edge portion.

11. The open-end wrench of claim 10, wherein when the sliding block is mounted in the sliding groove, the edge portion abuts against a surface of the second jaw.

12. The open-end wrench of claim 10, wherein the sliding block comprises a ramped surface.

13. The open-end wrench of claim 12, wherein a surface portion of the ramped surface is parallel to a surface portion of the first jaw.

14. The open-end wrench of claim 7, further comprising a dowel pin configured to be inserted through the opening in the second jaw.

15. The open-end wrench of claim 14, wherein the chuck has an elongated aperture, and the resilient member is disposed in the elongated aperture between the dowel pin and an end of the elongated aperture.

16. The open-end wrench of claim 15, wherein the protector stop is a protection pin disposed inside the resilient member so as to guide a movement of the resilient member inside the elongated aperture.

17. The open-end wrench of claim 16, wherein the protection pin comprises a cylindrical piece of metal.

18. The open-end wrench of claim 1, wherein a depth of the containing groove is greater than a distance between an extremity of the workpiece in contact with a surface of the chuck and a contact point of the workpiece in contact with an interior surface of the containing groove.

19. The open-end wrench of claim 18, wherein the depth is a distance between an edge of the second jaw and the contact point of the workpiece with the interior surface of the containing groove.

20. The open-end wrench of claim 1, wherein a distance between a first contact point between a first surface of the workpiece and a surface of the first jaw and a second contact point between a second surface of the workpiece and a surface of the chuck is greater than a distance between the first surface and the second surface of the workpiece.

21. The open-end wrench of claim 1, wherein the chuck comprises a ramped surface configured to contact the workpiece.

22. The open-end wrench of claim 21, wherein the ramped surface includes a surface portion parallel to a surface portion of the first jaw.

23. The open-end wrench of claim 1, wherein the chuck comprises a clamp splice configured to contact the workpiece.

24. The open-end wrench of claim 23, wherein the clamp splice includes a bump-shaped portion.

25. The open-end wrench of claim 1, wherein the resilient member is a spring.

26. The open-end wrench of claim 25, wherein the protector stop is disposed inside the spring.

27. The open-end wrench of claim 1, wherein the first jaw and the second jaw are fixed.

* * * * *